United States Patent [19]

Wehl

[11] Patent Number: 5,014,034

[45] Date of Patent: May 7, 1991

[54] THERMOSTATIC SWITCH WITH INSULATED CALIBRATION DIMPLE

[75] Inventor: Brandon L. Wehl, North Canton, Ohio

[73] Assignee: Portage Electric Products, Inc., North Canton, Ohio

[21] Appl. No.: 445,436

[22] Filed: Dec. 4, 1989

[51] Int. Cl.[5] ..... H01H 37/12; H01H 37/54; H01H 37/04

[52] U.S. Cl. ..... 337/368; 337/94; 337/112; 337/372

[58] Field of Search ..... 337/368, 94, 349, 360, 337/57, 372, 374, 380, 89, 112

[56] References Cited

U.S. PATENT DOCUMENTS

| | | | |
|---|---|---|---|
| 3,223,809 | 12/1965 | Wehl . | |
| 3,577,111 | 5/1971 | Nardulli | 337/372 |
| 4,335,368 | 6/1982 | Givler . | |
| 4,445,105 | 4/1984 | Wehl . | |
| 4,492,946 | 1/1985 | Loescher | 337/349 |
| 4,539,545 | 9/1985 | Klotz | 337/380 |
| 4,551,702 | 11/1985 | Hire | 337/360 |
| 4,620,175 | 10/1986 | Karr et al. | 337/89 |

FOREIGN PATENT DOCUMENTS

| | | | |
|---|---|---|---|
| 687139 | 5/1964 | Canada | 337/112 |
| 585590 | 2/1947 | United Kingdom | 337/360 |

*Primary Examiner*—Harold Broome
*Attorney, Agent, or Firm*—Darby & Darby

[57] ABSTRACT

A snap-action thermostatic switch, having a bimetallic member with a snap-action formed section bearing against a calibration dimple, has an insulative coating provided on the calibration dimple to prevent current flow through the dimple which could disrupt switch operation or cause damage to the bimetallic member.

12 Claims, 1 Drawing Sheet

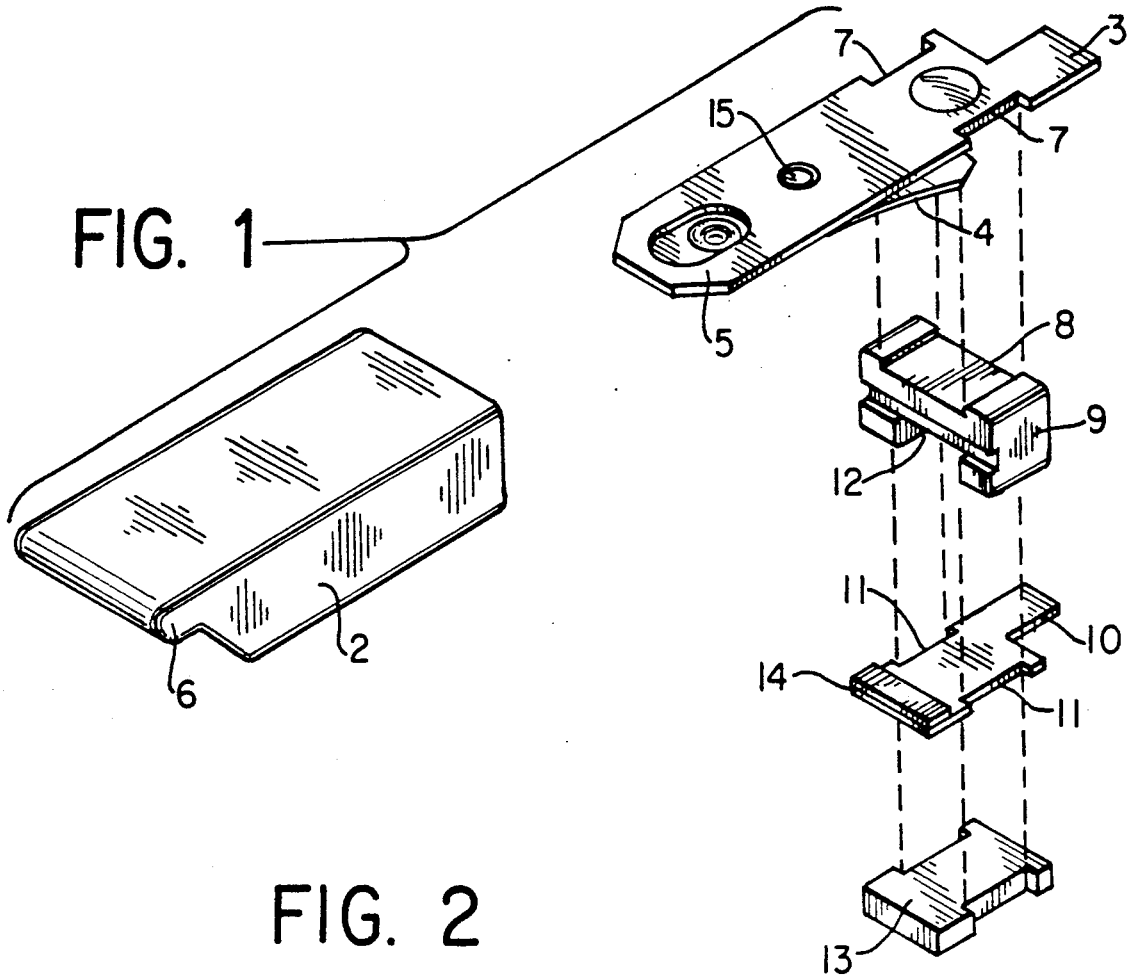
FIG. 1
FIG. 2
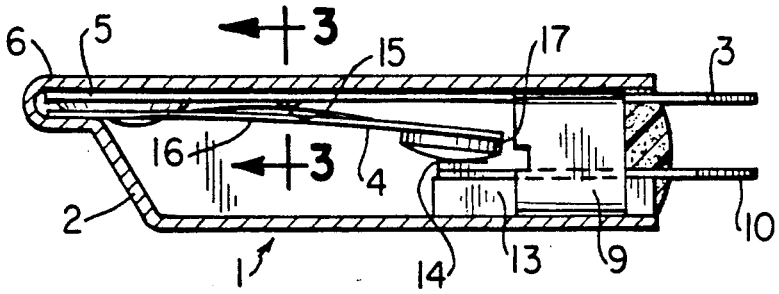
FIG. 3
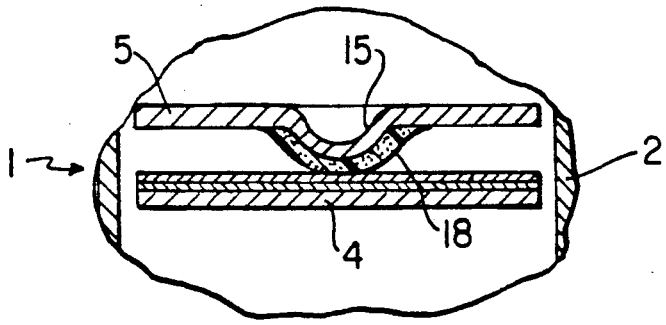

THERMOSTATIC SWITCH WITH INSULATED CALIBRATION DIMPLE

TECHNICAL FIELD

This invention relates to improvements in thermostatic switches and more particularly to a thermostatic switch including an insulated calibration dimple.

BACKGROUND OF THE INVENTION

Many thermostatic switches are known which have contacts mounted on one or more flexible strips, with at least one of the flexible strips being formed of or biased by a bimetal material for movement subject to temperature variations. With such constructions, it is possible to provide relatively accurate electrical control responsive to temperature changes.

One particular type of thermostatic switch is the snapaction thermostatic switch. The snap action is accomplished by the use of a formed section in a bimetallic member, the formed section usually being essentially dish-shaped, snapping from a convex to a concave, or a concave to a convex shape when a preset temperature is reached. A contact disposed at the end of the bimetallic member is thus moved into or out of engagement with a mating contact, resulting in a sudden separation of the two contacts.

In order to provide proper calibration of the thermostatic switch, as well as to provide a fulcrum for the moving member, a calibration dimple is formed in a portion of the thermostatic switch which bears against the bimetal member, and particularly against the formed section. Generally, this dimple is part of the top of the casing within which the switch is housed, formed by an indent, a mass of solder, or other means. Alternatively, this dimple could be provided on a contact strip from which the bimetallic member is supported. Because the bimetal member is prevented from bending beyond the fulcrum provided by the dimple, the member is prevented from moving closer to the casing, maintaining the member in contact with the opposed contact until such time as the formed section snaps.

It has been found, however, that thermostatic switches having calibration dimples provide a current leakage path through the dimple, which heats the formed section and causes an instability in the time required to trip the bimetallic member. Since this calibration dimple is usually positioned such that the formed section rests on the dimple, excess current leakage could also damage the formed section. Since the cross-sectional area of the dimple is quite small, a concentrated current flow through the dimple could produce arcing at that point which could burn a hole in the formed section.

SUMMARY OF THE INVENTION

It is an object of the present invention to provide a thermostatic switch which has a calibration dimple but does not allow current leakage through the dimple.

It is another object of the present invention to provide a thermostatic switch in which insulation means are provided on the dimple such that current leakage through the dimple is prevented.

These and other objects of the present invention are achieved by a thermostatic switch having at least one bimetallic member mounted in the casing and having a formed section, bearing against a calibration dimple provided in the casing. The dimple acts as a fulcrum, preventing free movement of the bimetallic member except about the fulcrum. Insulation means are provided on at least that portion of the dimple surface in contact with the bimetallic member.

By providing insulation means, such as an insulative polymer coating on the dimple, current leakage through the dimple is prevented and the potential for destabilized operation or damage to the bimetallic member is eliminated. Thus, thermostatic switch reliability and life expectancy is increased.

BRIEF DESCRIPTION OF THE DRAWINGS

FIG. 1 is a perspective assembly view showing the various parts of the thermostatic switch including the insulated dimple.

FIG. 2 is a sectional view of the fully assembled thermostatic switch, with the bimetallic member bearing against the insulated dimple of the present invention.

FIG. 3 is an enlarged cross-sectional view taken along the line 3—3 of FIG. 2.

DESCRIPTION OF THE PREFERRED EMBODIMENTS

Referring to FIG. 1, a thermostatic switch 1 has a casing 2, an upper contact strip 3 having a bimetallic member 4 cantilevered from a first end 5 of the upper contact strip 3 which rests in a receiving socket 6 of the casing. The upper contact strip 3 has an indented portion 7 which mates with an upper recess 8 in an insulator block 9. A lower contact strip 10 has an indented portion 11 which is disposed in a lower recess 12 in the block 9. The lower strip 10, resting on an insulator base 13, has a lower contact pad 14 at an end thereof. Both the insulator block 9 and the insulator base 13 may be formed of an electrically insulating ceramic material such as porcelain.

Referring to FIG. 2, the thermostatic switch is shown in cross-section. Within the casing 2, the first end 5 of the upper contact strip 3 rests in the receiving socket 6. The upper contact strip 3 has a dimple 15 provided adjacent to a formed section 16 in the bimetal member 4. The formed section, for illustrative purposes, is shown with a dished shape, but other shaped formed sections may also be used. The calibration dimple 15 acts as a fulcrum for the bimetallic member and is in continuous contact with the formed section 16. The member 4 has an upper contact pad 17 attached at the end thereof.

In this embodiment of the present invention, the lower contact strip 10 is composed of a non-bimetallic material and, therefore, does not change position in response to changes in temperature. However, since the upper contact pad 17 is mounted on the bimetallic member, it is movable in response to temperature variations, to complete or break a circuit. For example, when the appropriate temperature is reached, the formed section 16 in the bimetallic member 4 goes from concave to convex, a snap action disconnection occurs between the contacts 14 and 17.

The materials used for switch construction are those conventionally known in the field. The upper and lower contact strips are formed from an electrically conductive metal such as brass, with the bimetal member either formed totally of a bimetal material or formed of a composite metal strip including bimetal layers formed on one side thereof. The contact pads are typically formed of a silver alloy. The casing may be made of brass, steel, aluminum or another metal, or, if a dead case type thermostatic switch, the casing may be made of a nonconducting material.

Referring to FIG. 3, the dimple 15 is shown in an enlarged cross-section. The dimple 15 has an insulating layer 18 provided on the surface in contact with the formed section 16. For ease in illustration, the layer 18 is shown with an exaggerated thickness. Generally, the layer is composed of any suitable insulating material which is easily coated onto the dimple without adding substantially to the size of the dimple such that it would affect calibration. The material should also resist wear, as the snap action of the formed section may erode less wear resistant materials. An exemplary material for coating the dimple would be an insulative polymer applicable in liquid form. For example, an epoxy-type ink which is temperature sensitive and cures to form a good insulating layer may be used. Of course, other materials could be used to coat the dimple and achieve the results of the present invention.

While a single bimetallic biased member is shown it will be understood by those skilled in the art that the choice of bimetallic members, choice of insulating material, and whether one or both contact arms are bimetallic members are within the skill of one practicing in this art. While specific embodiments of the invention have been shown and described, the invention should not be considered as limited to these embodiments but also includes those within the scope of the present invention.

I claim:

1. In a thermostatic switch having an electrically conducting casing and having at least one bimetallic member responsive to temperature variations, the bimetallic member bearing against a calibration dimple formed in said electrically conducting casing, the improvement comprising:

insulation means disposed over the surface of the calibration dimple to prevent current leakage therethrough.

2. The thermostatic switch of claim 1 wherein the insulation means is an insulative polymer applicable in liquid form.

3. The thermostatic switch of claim 1 wherein the insulation means is a temperature sensitive epoxy ink, cured to form an insulating layer.

4. The thermostatic switch of claim 1 wherein the bimetallic member has a temperature responsive formed section bearing against the calibration dimple.

5. In a thermostatic switch having an electrically conducting casing with an open end, at least one bimetallic member cantilever supported by a contact strip mounted in said casing, said bimetallic member having a first contact at an end thereof, a second contact disposed within the casing and being contactable by the first contact, with the bimetallic member being so formed as to provide at appropriate temperatures for electrical and mechanical contact between the contacts, a calibration dimple formed in the electrically conducting casing and bearing against the bimetallic member, the improvement comprising:

insulation means disposed over the surface of the calibration dimple to prevent current leakage therethrough.

6. The thermostatic switch of claim 5 wherein the insulation means is an insulative polymer applicable in liquid form.

7. The thermostatic switch of claim 5 wherein the insulation means is a temperature sensitive epoxy ink, cured to form an insulating layer.

8. The thermostatic switch of claim 5 wherein the bimetallic member has a dish-shaped formed section bearing against the calibration dimple.

9. In a thermostatic switch having a casing with an open end, a first electrically conductive contact strip disposed in the housing supported by an insulating block mounted in said open end of said casing, a bimetallic member cantilever supported by the first contact strip, said bimetallic member having a moveable contact at the end thereof, and a second contact strip supported by said insulating block, the second contact strip having a static contact, said bimetallic member being so formed as to provide at appropriate temperatures for electrical and mechanical contact between said contacts, a fulcrum bearing against said bimetallic member, said fulcrum being in the form of a calibration dimple formed by indenting a wall of said first electrically conductive contact strip, the improvement which comprises:

an insulation coating provided over the surface of the calibration dimple such that a current path is not provided between the dimple formed on the first electrically conductive contact strip and the bimetallic member.

10. The thermostatic switch of claim 9 wherein the insulation coating is an insulative polymer applicable in liquid form.

11. The thermostatic switch of claim 9 wherein the insulation coating is a temperature sensitive epoxy ink, cured to form an insulating layer.

12. The thermostatic switch of claim 9 wherein the bimetallic member has a dish-shaped formed section bearing against the calibration dimple.

* * * * *